US010501905B2

(12) United States Patent
Han et al.

(10) Patent No.: US 10,501,905 B2
(45) Date of Patent: Dec. 10, 2019

(54) WAVE-SHAPED GROUTING BULB OF MICROPILE AND METHOD FOR FORMING SAME

(71) Applicant: KOREA INSTITUTE OF CIVIL ENGINEERING AND BUILDING TECHNOLOGY, Goyang-si, Gyeonggi-do (KR)

(72) Inventors: Jin Tae Han, Seoul (KR); Young Eun Jang, Goyang-si (KR)

(73) Assignee: KOREA INSTITUTE OF CIVIL ENGINEERING AND BUILDING TECHNOLOGY, Goyang-si, Gyeonggi-Do (KR)

( * ) Notice: Subject to any disclaimer, the term of this patent is extended or adjusted under 35 U.S.C. 154(b) by 0 days.

(21) Appl. No.: 16/097,929

(22) PCT Filed: Aug. 10, 2017

(86) PCT No.: PCT/KR2017/008672
§ 371 (c)(1),
(2) Date: Oct. 31, 2018

(87) PCT Pub. No.: WO2018/030805
PCT Pub. Date: Feb. 15, 2018

(65) Prior Publication Data

US 2019/0153692 A1 May 23, 2019

(30) Foreign Application Priority Data

Aug. 10, 2016 (KR) ..... 10-2016-0101940

(51) Int. Cl.
*E02D 3/12* (2006.01)
*E02D 5/48* (2006.01)
(Continued)

(52) U.S. Cl.
CPC ..... *E02D 5/48* (2013.01); *E02D 3/12* (2013.01); *E02D 5/54* (2013.01); *E02D 5/56* (2013.01);
(Continued)

(58) Field of Classification Search
CPC .... E02D 5/48; E02D 5/54; E02D 5/56; E02D 5/80; E02D 3/12; E02D 2200/1685
See application file for complete search history.

(56) References Cited

U.S. PATENT DOCUMENTS 3,277,968 A * 10/1966 Grimaud ..... E02D 5/385 173/145
3,391,544 A * 7/1968 Daczko ..... E02D 5/36 175/19
(Continued)

FOREIGN PATENT DOCUMENTS

JP 07-018651 1/1995
KR 10-1201829 11/2012
(Continued)

OTHER PUBLICATIONS

International Search Report for International Application No. PCT/KR2017/008672; dated Nov. 27, 2017.
(Continued)

*Primary Examiner* — Benjamin F Fiorello
(74) *Attorney, Agent, or Firm* — Kile Park Reed & Houtteman PLLC

(57) ABSTRACT

The present invention provides a wave-shaped grouting bulb (100) for securing an underground bearing capacity of a steel bar (10), the bulb comprising a plurality of protrusions (120), which have a predetermined maximum diameter (D1) and are formed along the longitudinal direction of a cylindrical pillar part (110) extending downward, wherein the neighboring protrusions (120) are formed to be spaced from
(Continued)

each other by a predetermined formation distance (s). The present invention has an advantageous effect of improving a skin friction force and resistance to compression and pullout in the grouting bulb integrated with the steel bar and thus enhancing structural stability in the micropile body.

2 Claims, 8 Drawing Sheets

(51) Int. Cl.
*E02D 5/56* (2006.01)
*E02D 5/80* (2006.01)
*E02D 5/66* (2006.01)
*E02D 5/54* (2006.01)

(52) U.S. Cl.
CPC ..... *E02D 5/665* (2013.01); *E02D 5/80* (2013.01); *E02D 2200/1685* (2013.01)

(56) References Cited

U.S. PATENT DOCUMENTS 3,422,629 A * 1/1969 Watts ..... E02D 5/36 175/292
3,494,134 A * 2/1970 Jorge ..... E02D 5/808 166/326
3,975,917 A * 8/1976 Asayama ..... E02D 5/54 405/232
4,386,876 A * 6/1983 Dupeuble ..... E02D 5/76 405/259.5
4,411,557 A * 10/1983 Booth ..... E02D 5/54 405/238
4,440,526 A * 4/1984 Koppers ..... E21D 21/0093 405/259.5
5,154,540 A * 10/1992 Barley ..... E02D 5/76 405/259.5
5,472,296 A * 12/1995 von Allmen ..... E02D 5/80 405/233
5,603,589 A * 2/1997 von Allmen ..... E02D 5/80 405/259.5
6,079,907 A * 6/2000 Valero Ruiz ..... E02D 29/0233 405/258.1
6,183,166 B1 * 2/2001 Schellhorn ..... E02D 5/38 405/233
7,445,406 B2 * 11/2008 Ortlepp ..... E21D 21/0026 405/259.1
9,115,478 B2 * 8/2015 Lutenegger ..... E02D 5/56
2011/0243666 A1 * 10/2011 Fox ..... E02D 3/08 405/232
2012/0037261 A1 * 2/2012 Nagata ..... E02D 5/56 138/177
2016/0145824 A1 * 5/2016 Lutenegger ..... E02D 13/02 405/252.1
2017/0342674 A1 * 11/2017 Masse ..... E02D 3/12
2018/0355573 A1 * 12/2018 Thomas ..... E02D 5/48

FOREIGN PATENT DOCUMENTS

KR 10-1378814 3/2014
KR 10-2016-0003940 1/2016

OTHER PUBLICATIONS

English translation of the Written Opinion of International Application No. PCT/KR2017/008672, dated Nov. 27, 2017.

* cited by examiner

WAVE-SHAPED GROUTING BULB OF MICROPILE AND METHOD FOR FORMING SAME

TECHNICAL FIELD

The present invention relates to a civil engineering field and, more particularly, to a micropile with a wave-shaped grouting bulb and a method for forming same, capable of improving a skin friction force and resistance to compression and pullout (hereinafter, referred to as a "bearing capacity"), in a grouting bulb integrated with a steel bar.

BACKGROUND ART

Generally, most buildings should have sufficient bearing capacities so that the foundation ground thereof supports these buildings. If not sufficient, subsidence occurs in the uppermost portion or the deep-seated portion of the foundation ground, resulting in deterioration of stability of a building that is built in an upper portion of the foundation ground.

Therefore, it should be necessary to investigate, through suitable various inspections such as geological investigation and soil exploration, whether a bearing capacity of the ground can sufficiently withstand the weight and load of a building applied to the ground. In the ground such as a reclaimed land, the unconsolidated ground, the ground decomposing organic substance layers, a peatland, a wetland, the ground having significant change in moisture, or the ground having lots of voids or being ununiform, a bearing capacity of the foundation ground is not sufficient, and thus higher bearing capacity is required for the foundation ground.

Also, in order to strengthen a foundation for a structure on the ground, a plurality of piles is driven into the soft ground, or the foundation is made with reinforced concrete by digging widely and deeply, and then the structure is constructed on this foundation. When various structures and facilities are present around the construction site, a condition for strengthening the foundation is often not formed. Also, if the foundation is explored widely while not exactly knowing positions of underground utilities, damage of utilities such as gas pipes is also caused.

Therefore, as a method for securing a bearing capacity about the foundation ground considering the foregoing matters, using a pile foundation reinforcing method has been well known. In addition to the above, there have been suggested various construction methods involving a grouting construction method in which a drilling operation is performed on the foundation ground using a hydraulic drill and a rod and bit of various drilling machines, a steel pipe such as rebar is inserted into the drilled hole, and then a reinforcing solution (a grouting liquid) is injected. Among these construction methods, a micropile can be considered a representative example.

This micropile started in Italy in 1950s, and then has been constructed globally for the purpose of reinforcing the ground and replacing a pile. The micropile has been called a mini pile, a micro pile, a root pile, and a GEWI pile, or the like depending on application purpose and range for each country.

A construction method of a conventional micropile is mainly divided into a drilling step, a steel bar inserting and installing step, a grouting step, and a head part finishing step.

First, a drilled hole is formed using bits having various diameters such as 76 mm, 80 mm, 90 mm, 105 mm, 115 mm, 152 mm, and 165 mm, and in a special case, bits having diameters of 200 mm or more would be used. Also, in the unstable ground, a casing is installed to a depth at which an inner wall of the drilled hole does not collapse, and then the inside thereof is drilled by using a bit to form a drilled hole.

When a drilling operation is completed, a steel bar combined with one rebar, or three or more rebar is inserted and installed.

When the steel bar is inserted and installed into the drilled hole, a grouting material is injected. That is, gravity grouting is performed right after a pile body is installed in the drilled hole. Here, the grouting is repeated about 3-6 times so as to compensate contraction phenomenon of the grout material.

When the grouting is completed, the head part finishing step is performed, in which a steel plate is fastened with a nut, or welding is carried out at an upper portion.

However, according to a conventional micropile construction method, this method is only possible for the foundation ground having bedrock, and when a micropile is constructed in the ground where only soil layers are present, it is impossible to secure high bearing capacity.

Also, since the steel bar constituting the micropile has a smaller diameter with respect to the length thereof, an end area of the pile is much smaller than an embedded vicinity area, and thus there has been a limitation that an end bearing capacity of the micropile is not generally considered in design.

In addition, during the grouting, the grouting material starts to fill the bottom portion of the drilled hole and is then injected until the grouting material flows out of the entrance of the drilled hole. Since a cementation time is long, and the grouting is repeated about 3-6 times so as to compensate the contraction phenomenon, constructability deteriorates, a construction period is getting longer, and an injection pressure cannot be uniformly maintained. Therefore, it is difficult to check a state filled with the grouting material and it is not easy to manage quality.

DISCLOSURE OF THE INVENTION

Technical Problem

The present invention is proposed to solve the problems a conventional micropile has, and it is a purpose of the present to improve a skin friction force and resistance to compression and pullout in a grouting bulb integrated with the steel bar and thus enhance structural stability in the micropile body.

It is another purpose of the present invention to form in advance a grouting bulb, prepared by jet-grouting, in a soil layer into which a steel bar of a micropile is inserted, and thus capable of constructing a micropile having high bearing capacity even in the soil layer where rock layers are not present.

It is still another purpose of the present invention to form in advance a grouting bulb, prepared by jet-grouting, in a soil layer presented in an upper portion of a rock layer, and thus enhance structural stability of a micropile with respect to the micropile constructed in the rock layer.

It is yet another purpose of the present invention to easily form a grouting bulb capable of improving structural stability of a micropile.

It is a further purpose of the present invention to provide numerical values capable of securing a maximum ultimate bearing capacity of a micropile having a cross-section formed in waveform.

Technical Solution

According to one aspect of the present invention, provided is a wave-shaped grouting bulb 100 for securing an underground bearing capacity of a steel bar 10, the wave-shaped grouting bulb 100 being characterized by including a plurality of protrusions 120, which have a uniform maximum diameter (D1) and are formed along the longitudinal direction of a cylindrical pillar part 110 extending downward, wherein the neighboring protrusions 120 are formed to be spaced from each other by a predetermined formation distance (s).

In this case, the wave-shaped grouting bulb may be characterized in that a longitudinal cross-section of the wave-shaped grouting bulb 100 forms a waveform.

In addition, the wave-shaped grouting bulb may be characterized in that the steel bar 10 is inserted into the pillar part 110.

In addition, the wave-shaped grouting bulb may be characterized in that a length (L) of the protrusions 120 is the maximum diameter (D1).

In addition, the wave-shaped grouting bulb may be characterized in that the formation distance (s) is twice the maximum diameter (D1).

In addition, the wave-shaped grouting bulb may be characterized in that a length (L) of the protrusions 120 is twice the maximum diameter (D1).

In addition, the wave-shaped grouting bulb may be characterized in that the formation distance (s) is twice the maximum diameter (D1).

According to another aspect of the present invention, provided is a method for forming a wave-shaped grouting bulb, wherein a micropile is constructed using jet-grouting, the method being characterized by including: a first step (A100) of forming a drilled hole 2 by using a jet-grouting device 200 which includes a drilling machine 230 that drills a ground 1 to form the drilled hole 2, a grout material spray hole 220 that sprays a grout material, and a grout material feeding pipe 210 that supplies the grout material to the grout material spray hole 220, and forming the grouting bulb by spraying, at high pressure, the grout material from the grout material spray hole 220 into the drilled hole 2; a second step (A200) of withdrawing the jet-grouting device 200 out of the drilled hole 2, and forming the pillar part 110 inside the drilled hole by spraying the grout material 3 from the grout material spray hole into the drilled hole 2; and a third step (A300) of inserting the steel bar 10 into the pillar part 110.

Advantageous Effects

According to the present invention, there is an effect of improving a skin friction force and resistance to compression and pullout in a grouting bulb integrated with a steel bar, and thus capable of enhancing structural stability in a micropile body.

According to the present invention, there is an effect of forming in advance a grouting bulb, prepared by jet-grouting, in a soil layer into which a steel bar is inserted, and thus capable of constructing the micropile having high bearing capacity even in the soil layer where rock layers are not present.

According to the present invention, there is an effect of forming in advance a grouting bulb, prepared by jet-grouting, in a soil layer presented in an upper portion of a rock layer, and thus capable of enhancing structural stability of a micropile with respect to the micropile constructed in the rock layer.

According to the present invention, there is an effect of easily forming a grouting bulb capable of improving structural stability of a micropile.

According to the present invention, there is an effect of obtaining equivalent bearing capacity even when using a micropile having a shorter length than an existing micropile.

According to the present invention, it is possible to construct a micropile having a maximum ultimate bearing capacity.

MODE FOR CARRYING OUT THE INVENTION

Figure 1:
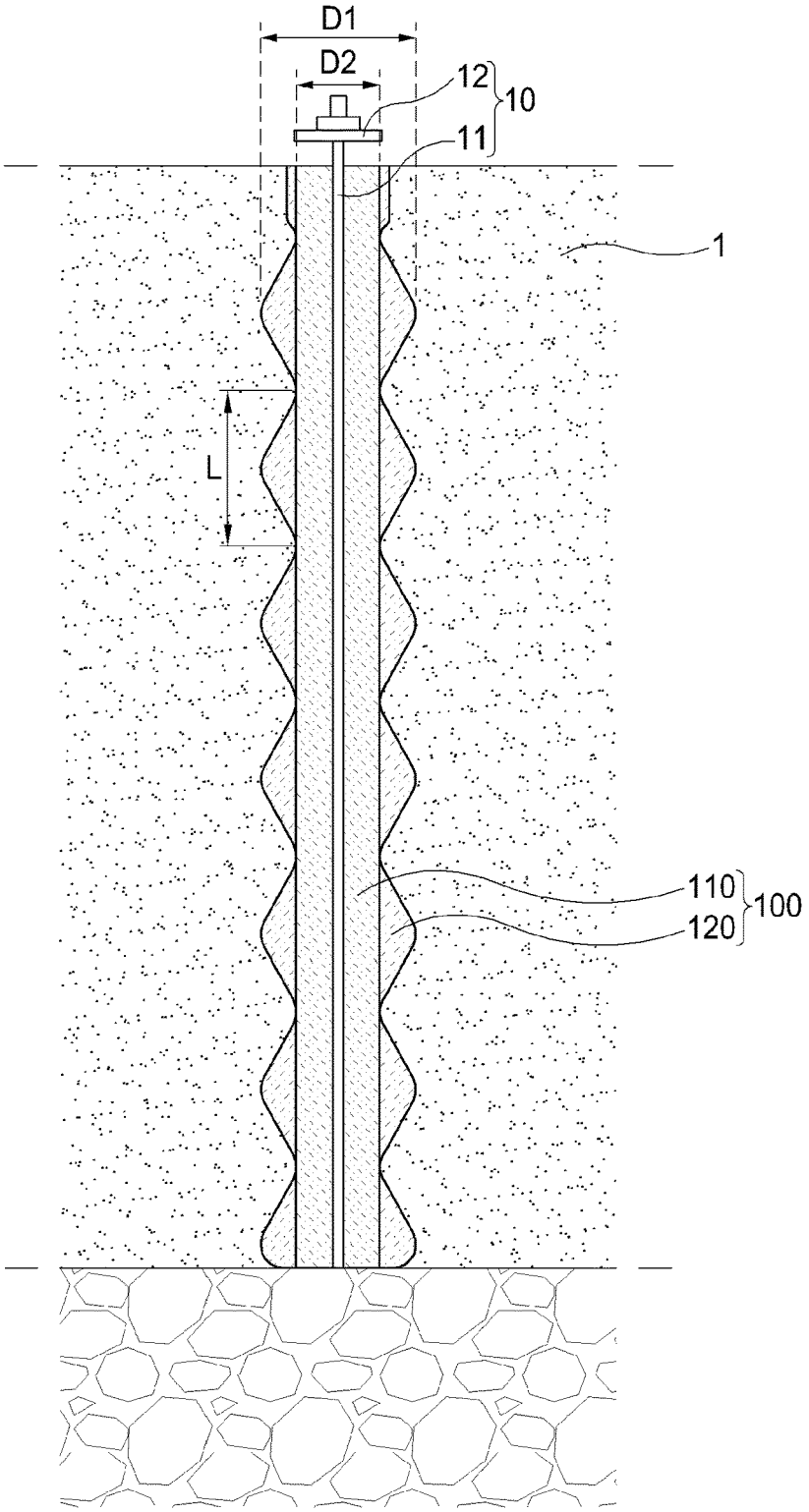
FIG. 1 is a view illustrating a cross-section of a micropile in which a general and conventional waveform cross-section is applied.

Embodiments of a micropile with a wave-shaped grouting bulb and a method for forming same in accordance with the present invention will be described in detail with reference to the accompanying drawings. In describing the present invention with reference to the accompanying drawings, identical or corresponding elements will be assigned with same reference numerals, and no redundant description thereof will be provided.

Terms such as first and second can be used in merely distinguishing one element from other identical or corresponding elements, but the above elements should not be restricted to the above terms such as first and second.

When one element is described to be coupled to another element, it does not refer to a physical, direct contact between these elements only, but it shall also include the possibility of yet another element being interposed between these elements and each of these elements being in contact with said yet another element.

FIG. 1 is a view illustrating a construction state of a micropile in which a grouting bulb with a conventional waveform cross-section is applied.

The waveform cross-section of the conventional grouting bulb has a shape in which a plurality of protrusions 120 forming the waveform is continuously connected.

Also, since shapes and sizes of the protrusions 120 are irregular, there has been a phenomenon that concentrated stress occurs at specific portions of the protrusions 120, which has made it difficult to secure stable bearing capacity of the micropile.

Accordingly, the present invention intends to provide a shape of a wave-shaped grouting bulb allowing a steel bar 10 to have a maximum ultimate bearing capacity by suggesting a length (L) and a formation distance (s) of the protrusions 120.

Figure 2:
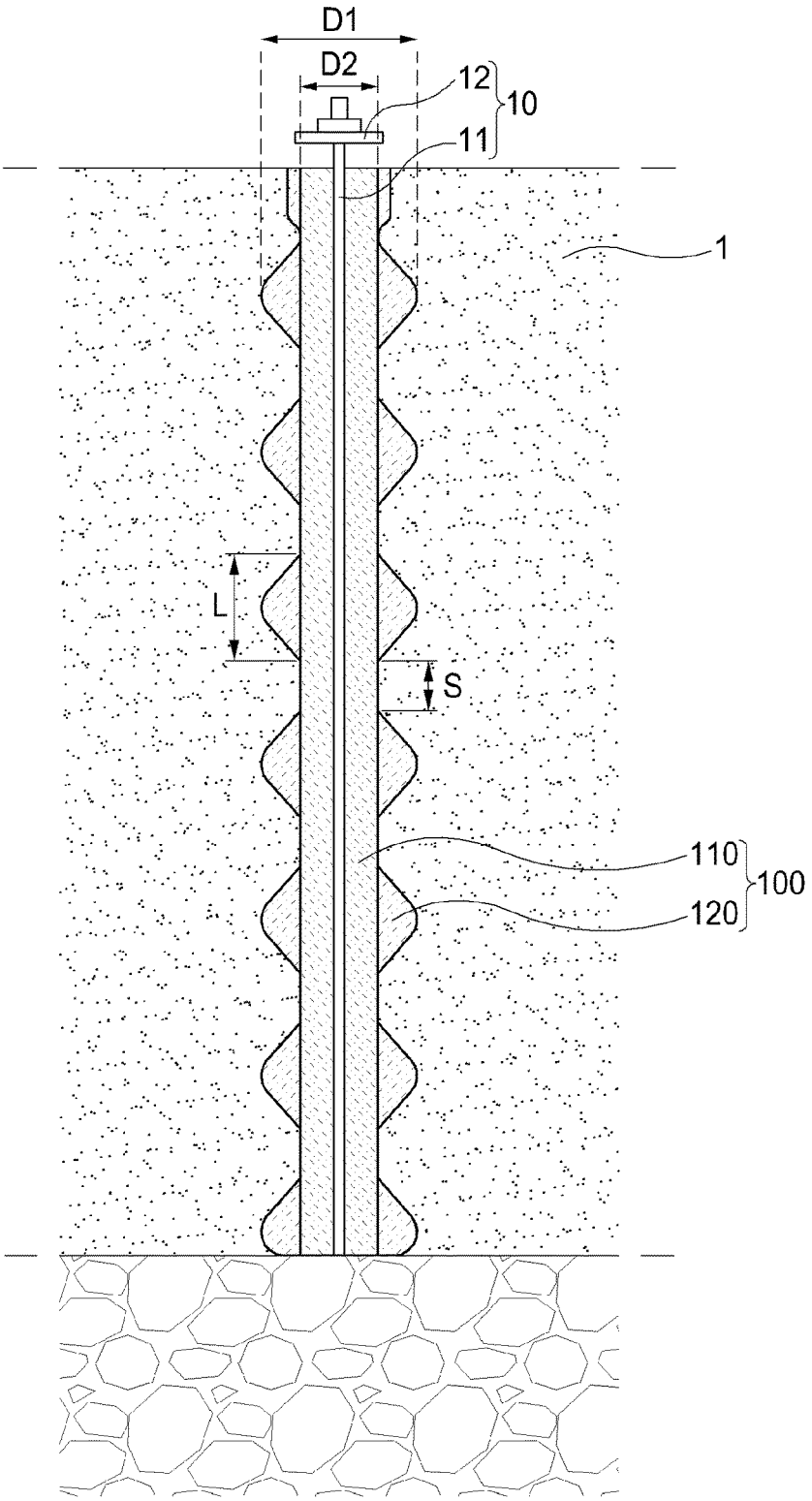
FIG. 2 is a view illustrating a cross-section of a micropile according to one embodiment of the present invention.
Figure 3:
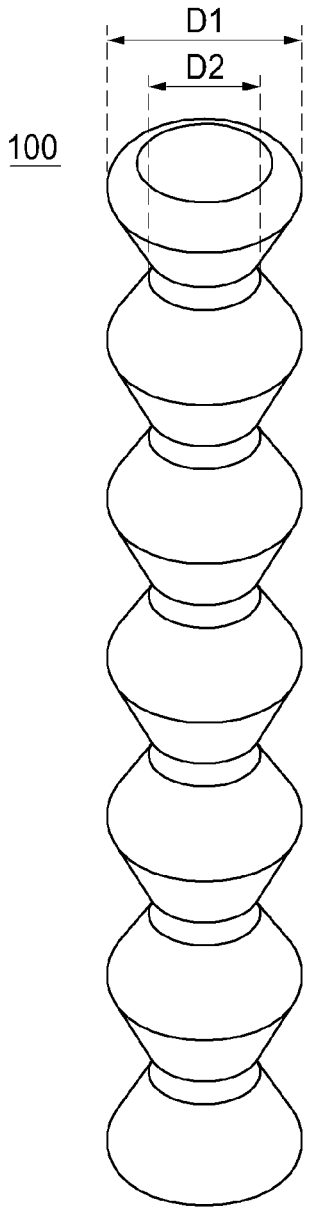
FIG. 3 is a perspective view of a grouting bulb into which a steel bar according to one embodiment of the present invention is inserted.
Figure 4:
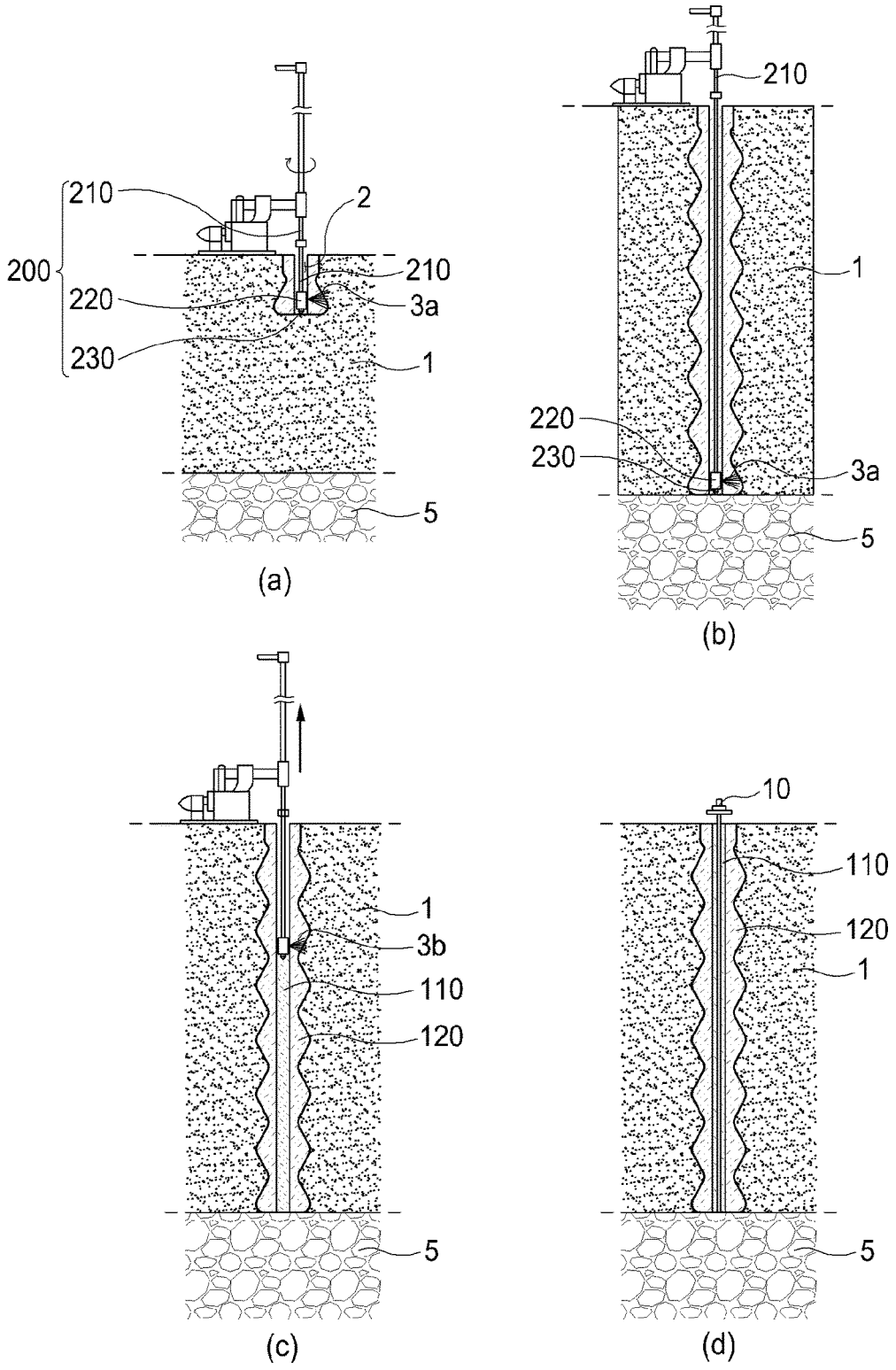
FIG. 4 is a view illustrating a method for forming a wave-shaped grouting bulb according to one embodiment of the present invention.

A wave-shaped grouting bulb according to one embodiment of the present invention is characterized in that there are formed a plurality of protrusion 120, which have a uniform maximum diameter (D1) and are formed along the longitudinal direction of a cylindrical pillar part 110 extending downward, wherein the neighboring protrusions 120 are formed to be spaced from each other by a predetermined formation distance (s) (FIG. 2).

Accordingly, the longitudinal cross-section of a grouting bulb 100 according to the present invention forms a wave-form.

A steel bar 10 generally includes: a steel bar 11 inserted into the ground; and a head part 12 connected to an upper portion of the steel bar 11 which are exposed above the ground, and preventing the steel bar 11 from being introduced inside the ground (FIG. 1).

The steel bar 11 of the steel bar 10 is inserted and fixed into a pillar part 110.

The steel bar 11 is inserted into the pillar part 110 before a grout material for forming the pillar part 110 is cured, and then as the pillar part 110 is being cured, the grouting bulb 100 and the steel bar 10 may be integrally formed.

When compared to the protrusions 120 of the conventional wave-shaped grouting bulb in which the neighboring protrusions 120 are continuously formed, the protrusions 120 of the wave-shaped grouting bulb according to the present invention, in which the neighboring protrusions 120 are formed spaced from each other by a predetermined formation distance (s), may secure much higher ultimate bearing capacity.

Figure 5:
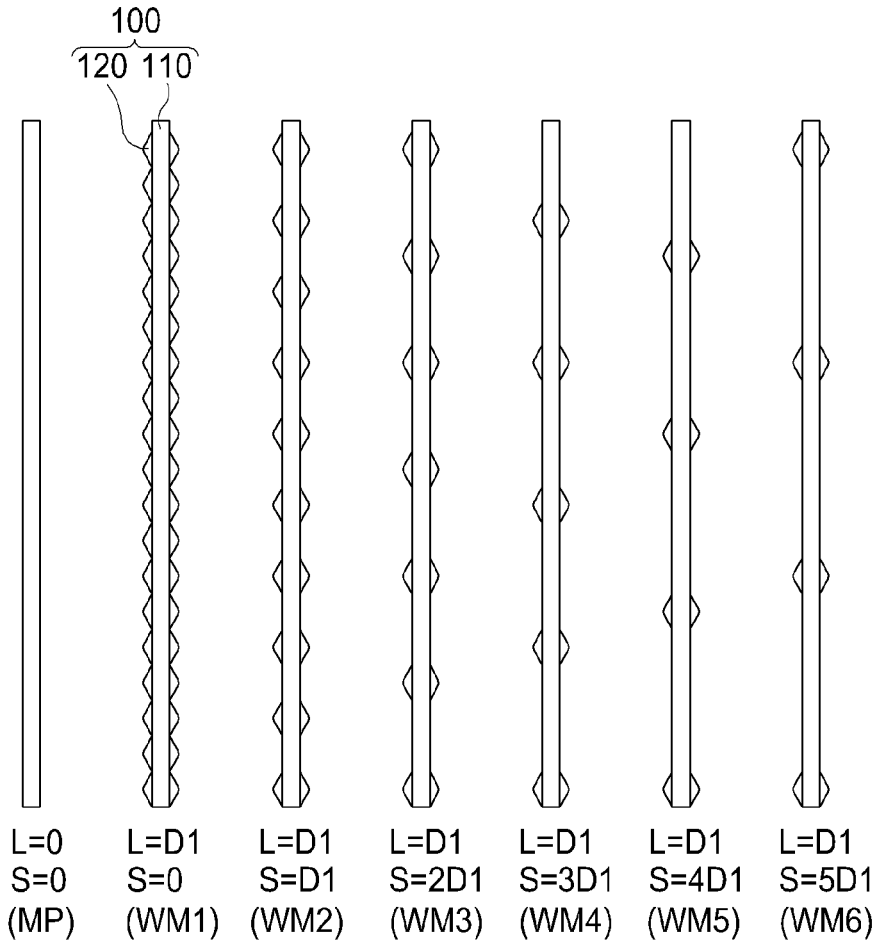
FIG. 5 is a view illustrating shapes of various grouting bulbs which are tested for securing a maximum ultimate bearing capacity when a length of a protrusion is a maximum diameter of a grouting bulb.
Figure 6:
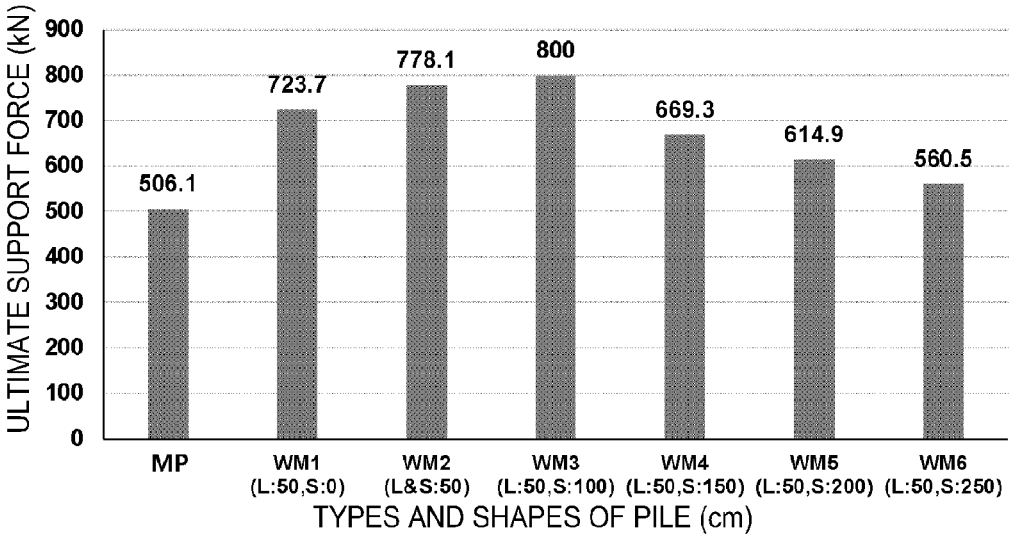
FIG. 6 is a view illustrating ultimate bearing capacities of various grouting bulbs which are tested for securing a maximum ultimate bearing capacity when a length of a protrusion is a maximum diameter of a grouting bulb.
Figure 7:
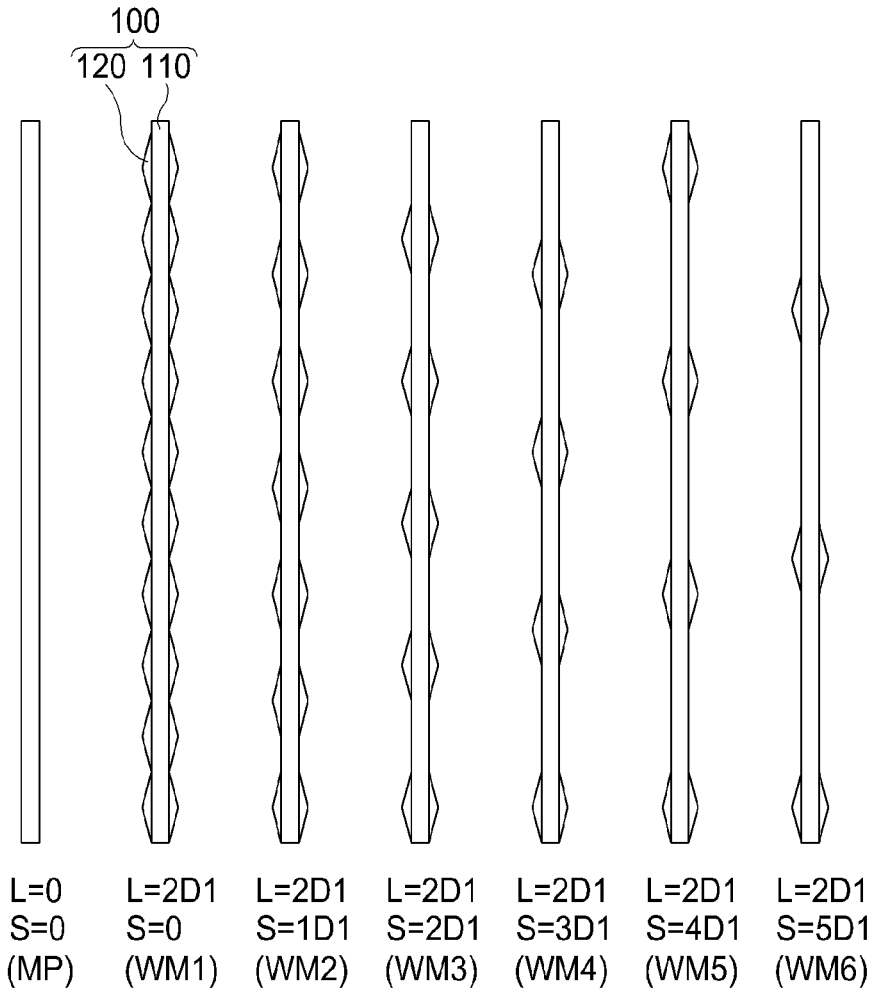
FIG. 7 is a view illustrating shapes of various grouting bulbs which are tested for securing a maximum ultimate bearing capacity when a length of a protrusion is twice a maximum diameter of a grouting bulb.

This effect can be confirmed with reference to FIGS. 5 and 6.

FIG. 5 is a view illustrating shapes of various grouting bulbs which are tested for securing a maximum ultimate bearing capacity when a length of a protrusion is a maximum diameter of a grouting bulb.

FIG. 6 is a view illustrating data with regard to ultimate bearing capacities of the micropiles corresponding to the grouting bulbs shown in FIG. 5.

Referring to the data of FIG. 6, when compared to a conventional grouting bulb WM1 in which a formation distance (s) is formed to be zero and an ultimate bearing capacity is 723 (kN), it may be confirmed that grouting bulbs WM2 and WM3 according to one embodiment of the present invention, in which protrusions 110 are formed spaced from each other by a formation distance (s), exert a higher ultimate bearing capacity although including a smaller numbers of protrusions 110 than the conventional grouting bulb.

When a distance (L) of a protrusion 120 is a maximum diameter (D1), a formation distance (s) which is twice the maximum diameter (D1) may secure a maximum ultimate bearing capacity (FIG. 6).

Figure 8:
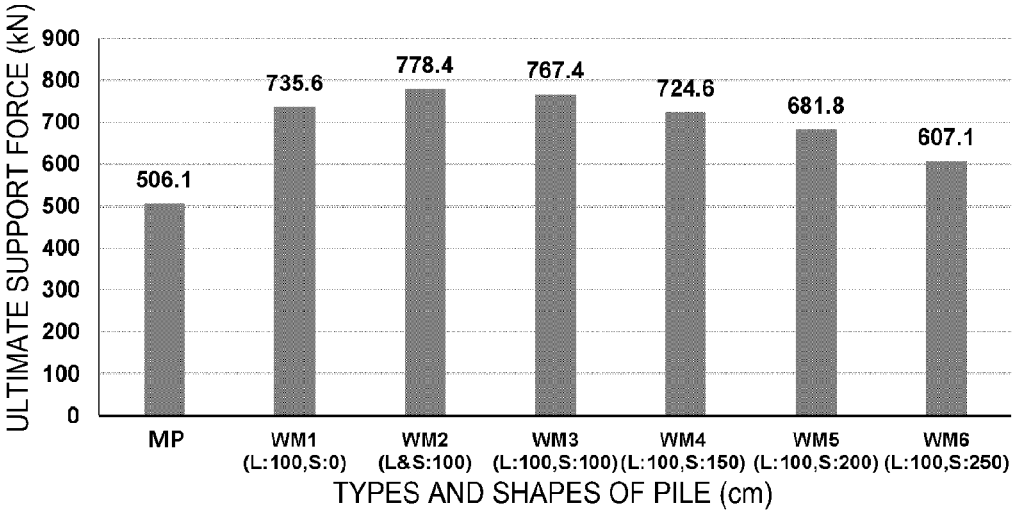
FIG. 8 is a view illustrating ultimate bearing capacities of various grouting bulbs which are tested for securing a maximum ultimate bearing capacity when a length of a protrusion is twice a maximum diameter of a grouting bulb.

Also, when a distance (L) of a protrusion 120 is twice a maximum diameter (D1), a formation distance (s) which is twice the maximum diameter (D1) may secure a maximum ultimate bearing capacity (FIG. 8).

When a distance (L) of a protrusion 120 is a maximum diameter (D1) or less, it is difficult to form grouting bulbs in a construction site because the spacing between the grouting bulbs becomes too small.

When the distance (L) of the protrusion 120 is twice the maximum diameter (L), there is a limitation such as excessive construction and a rise in construction costs due to increased grout volume.

Therefore, considering site constructability and economic feasibility, experiments have been performed with respect to the lengths (L) of the protrusion 120, which range from the maximum diameter (D1) to twice the maximum diameter (D1).

Referring to the data in FIG. 6 and FIG. 8, it may be confirmed that WM3 has a higher ultimate bearing capacity than WM1.

That is, since the ultimate bearing capacity may be secured without forming continuous protrusions 100, construction difficulties may be solved and construction expenses may be reduced by saving grout materials. Most of all, the high bearing capacity may be secured to achieve the structural stability in a micropile-based structure.

Hereinafter, a method for forming the wave-shaped grouting bulb according to one embodiment of the present invention will be described.

In the method for forming the wave-shaped grouting bulb, a first step (A100) is performed of forming a drilled hole 2 by using jet-grouting device 200 which includes a drilling machine 230 that drills a ground 1 to form the drilled hole 2, a grout material spray hole 220 that sprays a grout material, and a grout material feeding pipe 210 that supplies the grout material to the grout material spray hole 220, and forming the grouting bulb by spraying, at high pressure, the grout material from the grout material spray hole 220 into the drilled hole 2.

After the first step (A100), a second step (A200) is performed of withdrawing the jet-grouting device 200 out of the drilled hole 2, and forming the pillar part 110 inside the drilled hole by spraying the grout material 3 from the grout material spray hole into the drilled hole 2.

Furthermore, after the second step (A200), a third step (A300) is performed of inserting the steel bar 10 into the pillar part 110.

The grout material 3 according to one embodiment of the present invention includes a first grout material 3*a* for forming the protrusion 120 and a second grout material 3*b* for forming the pillar part 110.

The above is merely described with respect to preferred embodiments that may be implemented according to the present invention, and thus as is well known, the scope of the present invention should not be construed as being limited by the above embodiment, the technical ideas of the present invention described above and technical concepts on the basis of these technical ideas are considered to be included in the scope of the present invention.

The invention claimed is:

1. A method for forming a wave-shaped grouting bulb for securing an underground bearing capacity of a steel bar, wherein a micropile is constructed using jet-grouting, the method comprising:

a first step of forming a drilled hole by using a jet-grouting device which comprises a drilling machine that drills a ground to form the drilled hole, a grout material spray hole that sprays a grout material, and a grout material feeding pipe that supplies the grout material to the grout material spray hole, and forming the grouting bulb by spraying, at high pressure, the grout material from the grout material spray hole into the drilled hole;

the wave-shaped grouting bulb comprising:

a plurality of protrusions, which have a uniform maximum diameter and are formed along the longitudinal direction of a cylindrical pillar part extending downward, wherein the neighboring protrusions are formed to be spaced from each other by a predetermined formation distance, the wave-shaped grouting bulb, wherein a longitudinal cross-section of the wave-shaped grouting bulb forms a waveform, the wave-shaped grouting bulb, wherein the steel bar is inserted into the pillar part, the wave-shaped grouting bulb, wherein a length of the protrusions is twice the maximum diameter, the wave-shaped grouting bulb, wherein the formation distance is the maximum diameter or twice the maximum diameter.

2. The method of forming the wave-shaped grouting bulb of claim 1, further comprising:

a second step of withdrawing the jet-grouting device out of the drilled hole, and forming the pillar part inside the drilled hole by spraying the grout material from the grout material spray hole into the drilled hole; and a third step of inserting the steel bar into the pillar part.

* * * * *